United States Patent [19]

Mesler

[11] 4,215,485

[45] Aug. 5, 1980

[54] BOW SIGHT

[76] Inventor: Gilbert T. Mesler, R.D. #1, Ashville, N.Y. 14710

[21] Appl. No.: 32,300

[22] Filed: Apr. 23, 1979

[51] Int. Cl.[2] ..... F41G 1/00; F41B 5/00

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,455,027 | 7/1969 | Perkins | 33/265 |
| 4,136,462 | 1/1979 | Topel | 33/265 |
| 4,159,575 | 7/1979 | Kalmbach | 33/265 |
| 4,162,579 | 7/1979 | James | 33/265 |

*Primary Examiner*—Steven L. Stephan

*Attorney, Agent, or Firm*—Charles L. Lovercheck

[57] ABSTRACT

A bow sight is disclosed in combination with a bow. The bow sight is made of a single U-shaped piece of metal having flanges formed at each side at an intermediate part for stiffness to the sight. The sight is adapted to be attached to a bow. One of the U-shaped legs has a single aperture and the other has three apertures so that the bowman can correct his sighting range. The apertures can also be used for "bore sighting" the arrows.

5 Claims, 4 Drawing Figures

BOW SIGHT

REFERENCE TO PRIOR ART

Bow sights are shown in U.S. Pat. Nos. 2,500,509; 2,814,284; 3,365,800; 3,696,517; 3,798,783; and 3,811,195. However, none of these patents show the simplified efficient structure capable of the formation of applicant's bow sight.

OBJECTS OF THE INVENTION

It is an object of the invention to provide an improved bow sight.

Another object of the invention is to provide a bow sight that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
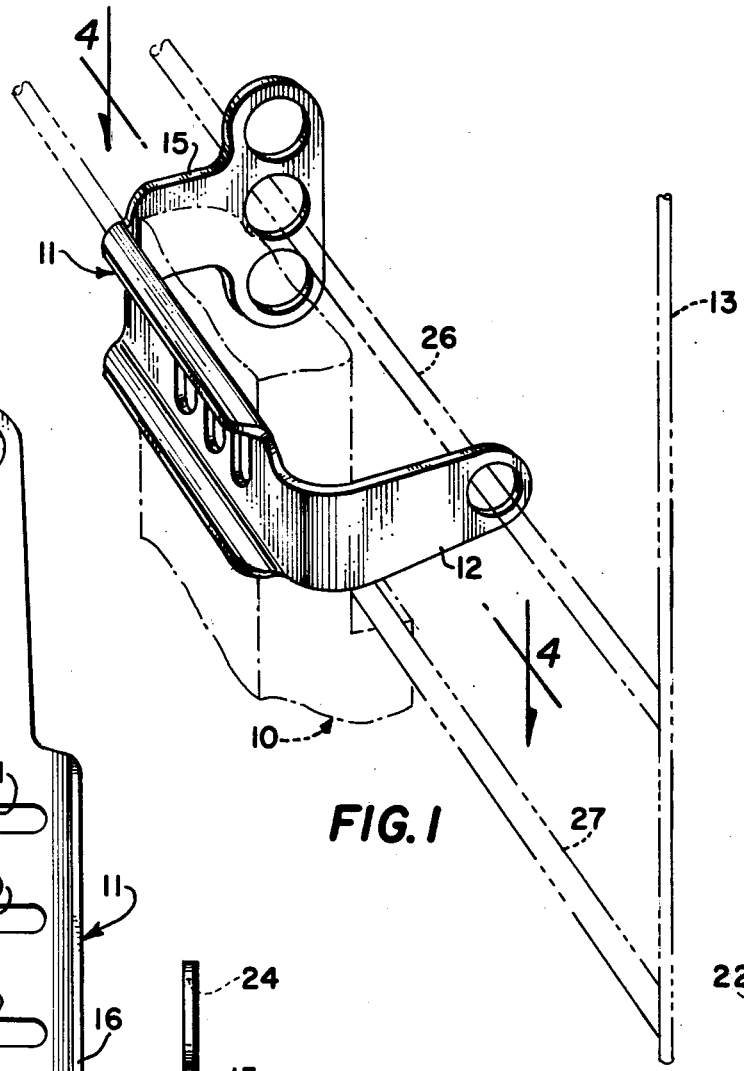
FIG. 1 is a side view partly broken away, showing a bow and a bow sight according to the invention.
Figure 2:
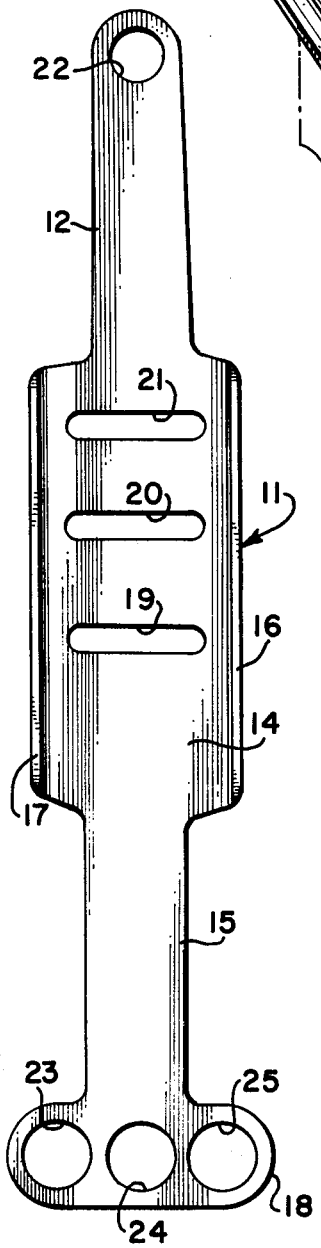
FIG. 2 is a view of the bow sight before being bent into final shape for use.
Figure 4:
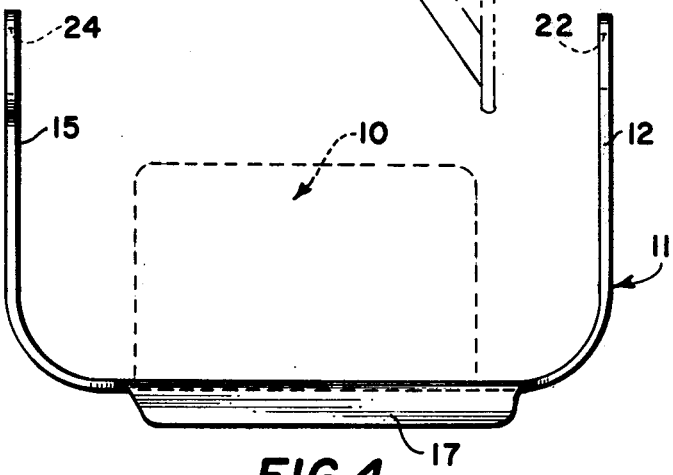
FIG. 4 is a cross-sectional view taken on Line 4—4 of FIG. 1.
Figure 3:
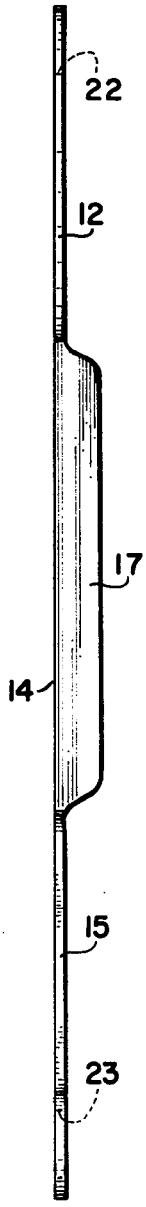
FIG. 3 is a side view of the bow sight shown in FIG. 2.

Now, with more particular reference to the drawings, the combination bow and bow sight are shown in FIG. 1 wherein a bow 10 has the sight 11 supported on it. The bow 10 has a body 12 and bow string 13 which may be of conventional type of bow, for example it can be the type of bow known as the compound bow. The sight 11 may be made of a single piece of material either metal or plastic or other suitable material bent into a U-shape as shown in FIG. 4. Sight 11 has a first end 12 and an intermediate part 14 and a second end 15. The intermediate part 14 has the material bent outward forming flanges 16 and 17 on it to provide rigidity. Slots 19, 20 and 21 are formed in the intermediate part through which screws or other suitable fastening means may be used to attach the bow sight to the bow. The first end has the opening 22 formed therein through which the hunter sights, and the second end 15 is T-shaped and has the T-shaped portion 18 with the three openings 23, 24 and 25.

Slots 20, 21 and 22 can be used to adjust the position of the bow sight on the bow and the sight itself being flexible can be bent to adjust the sight relative to the bow.

The openings 22, 23, 24 and 25 are large enough to receive an arrow so that an arrow can be passed through the bow sight in a position on the arrow indicated at 26 for sighting in the bow. Normally, the arrow would be in the position indicated at 27.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a bow and a bow sight (11) comprising, a bow (10) and a sight (11), said bow (10) having a body (12), and a bow string (13), said bow sight (11) comprising a sheet of metallic material said metallic material having a first end part (12) and a second end part (15) and an intermediate part (14), said first end part (12), said second end part (15) being integrally attached to said intermediate part (14), spaced laterally extending openings (19, 20 and 21) in said intermediate part of said bow sight, fastening means (23) in said laterally extending openings (19, 20 and 21) holding said sight (11) to said bow (10), an arrow receiving opening (22) in the distal end of said first end of said sight (11), three laterally spaced second arrow receiving openings (23, 24 and 25) in said second end of said bow sight (11), said first end and said second end being bent at right angles to said intermediate portion (14) with said openings (22) in said first end (12) in alignment with one of said openings in said second end providing a peep sight.

2. The combination recited in claim 1 wherein said openings are adapted to receive an arrow for sighting in said bow, said second end (15) being T-shaped having the distal end of said second end (15) forming the bar (18) of said T.

3. The combination recited in claim 1 wherein said spaced openings are slots, said intermediate part (14) being wider than said end parts and having its edges turned up forming spaced flanges (16,17).

4. The combination recited in claim 1 wherein said intermediate part of said sight is wider than the end part, and the sides of said intermediate part are turned up providing flanges.

5. The combination recited in claim 1 wherein said second end of said sight is in the shape of the bar of a "T".

* * * * *